US005159138A

United States Patent [19]

Kleinhans

[11] Patent Number: 5,159,138

[45] Date of Patent: Oct. 27, 1992

[54] SUPPORT MEANS FOR MUSICAL PERCUSSION ELEMENTS

[75] Inventor: John Kleinhans, West Hurley, N.Y.

[73] Assignee: Woodstock Percussion Inc., West Hurley, N.Y.

[21] Appl. No.: 694,502

[22] Filed: May 2, 1991

[51] Int. Cl.[5] ..... G10D 13/08

[52] U.S. Cl. ..... 84/403; 84/402

[58] Field of Search ..... 84/402, 403, 421; 428/99, 100; 248/205.2

[56] References Cited

U.S. PATENT DOCUMENTS 4,406,207 9/1983 Criscione ..... 84/421
4,543,871 10/1985 Kvistad ..... 84/403
4,669,353 6/1989 Kvistad ..... 84/403
4,885,972 12/1989 Chen ..... 84/403
4,909,124 3/1990 Chang ..... 84/403

*Primary Examiner*—William M. Shoop, Jr.
*Assistant Examiner*—Helen Kim
*Attorney, Agent, or Firm*—Charles J. Brown

[57] ABSTRACT

In a musical percussion instrument where percussion elements are arranged side-by-side, support for the percussion elements which includes a base member grooved to receive the percussion elements and matching hook-and-pile self-fastening fabric elements on both the base member grooves and the percussion elements to hold the latter in place on the grooves in spaced relation with the surface of the grooves.

9 Claims, 1 Drawing Sheet

SUPPORT MEANS FOR MUSICAL PERCUSSION ELEMENTS

BACKGROUND OF THE INVENTION

Percussion elements, as the term is used herein, are tubes or bars or the like arranged side-by-side to emit sound when struck. Such musical instruments are sometimes generically called ideophones, and within that grouping are xylophones, metalophones, tubaphones and the like.

The quality of sound emitted by a percussion element is at an optimum when it is supported by means which absorb maximum vibration when the element is stuck and hence transmit minimum vibration to whatever structure is beneath it. Generally speaking the less contact between a percussion element and the structure upon which it is supported, the less vibration will be transmitted and the higher the quality of its emitted sound. Most conventional percussion instruments include a pair of side rails supporting the opposite ends of the percussion elements usually at their nodal points. Rubber cradles mounted in side rails are disclosed in U.S. Pat. No. 4,543,871 and substantially rigid but elastically deformable side rails are taught in U.S. Pat. No. 4,669,353. There is a disclosure in U.S. Pat. No. 4,885,972 of percussion elements having opposite end portions lying in troughs of what are called wave-shaped supports and they are held there in place by overlying cushioned members.

The principal object of the present invention is to provide percussion element support means which achieve optimum vibration absorption for high quality emitted sound. In contrast to the prior art, the support means of the invention are to involve minimal contact with the percussion elements. In addition the invention has as its purpose a support design of great simplicity and one which allows the percussion elements to be easily attached and detached. All of these purposes are achieved by a particular use of common nylon material known as self-fastening fabric, which is to say material made with mating surfaces of tiny hooks and clinging pile which can be pressed together or pulled apart for easy fastening and unfastening. Material sold under the trademark VELCRO is representative of this kind of self-fastening fabric.

SUMMARY OF THE INVENTION

The invention provides support means for a plurality of side-by-side elongated percussion elements in a musical percussion instrument. A base member is included which has an upper surface formed with a plurality of side-by-side elongated grooves in which the respective percussion elements are longitudinally disposed. Each groove has side walls configured such that two parallel longitudinal first locus lines thereon are juxtaposed with two parallel second locus lines on each associated percussion element. First self-fastening fabric elements are secured to the groove side walls across the first locus lines thereon. Second self-fastening fabric elements are secured to the surface of each percussion element across the second locus lines thereon. The first and second self-fastening fabric elements engage one another and hold the percussion elements to the base member in spaced relation with the upper surface thereof.

In a preferred form of the invention the grooves extend fully across the upper surface of the base member and may be of substantially sinusoidal cross section.

The first self-fastening fabric elements may be a pair of strips extending continuously from one of the grooves to the next on the upper surface of the base member. The second self-fastening fabric elements may be pairs of patches spanning the second locus lines on the respective percussion elements preferably substantially at the nodal points thereof.

DESCRIPTION OF PREFERRED EMBODIMENT

In this representative embodiment four percussion elements 10A, 10B, 10C and 10D are shown, though of course they could be of any number in a given musical instrument. The percussion elements in this example are tubular and of metal with dimensions typically of $\frac{7}{8}$ inch diameter and a wall thickness of 0.05 inch. They are of varying lengths chosen to emit the desired musical notes. As is recognized in the physics of sound each of the elements has two nodal points where there is little or no vibration when the element is stuck. These nodal points are approximately one-fifth of the total length of the element inwardly from each extremity. Ideally the support means for the percussion elements 10A to 10D should be at their respective nodal points and should entail minimal contact with the elements other than at those nodal points. In addition the support means for the elements should be capable of maximum vibration absorption. Finally, the support means should permit the elements to be attached and detached for easy assembly and disassembly.

These purposes are achieved by the support means of the invention which includes a base member 12. It is preferably of wood and varies in width from a narrow end 13 where the shortest element is to be supported to a wide end 14 where the longest element is to be supported. Parallel to the ends 13 and 14 of the base member 12 and across its upper surface are a succession of side-by-side elongated grooves 15A, 15B, 15C and 15D. These grooves present a wave-like or substantially sinusoidal crosssection to the upper surface of the base member 12 as is clearly shown in FIGS. 2 and 3.

Figure 1:
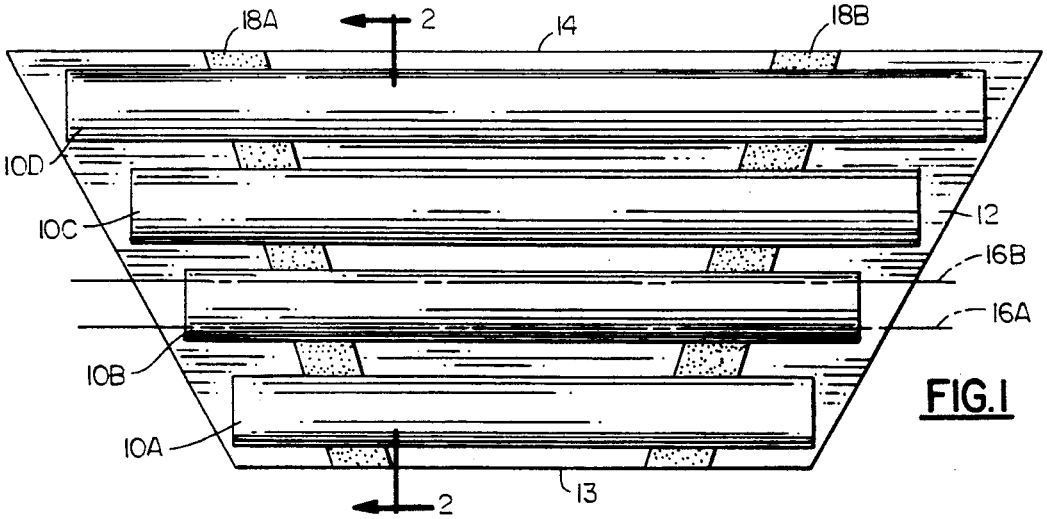
FIG. 1 is a plan view of one form of the percussion elements of the invention and their support means.
Figure 2:
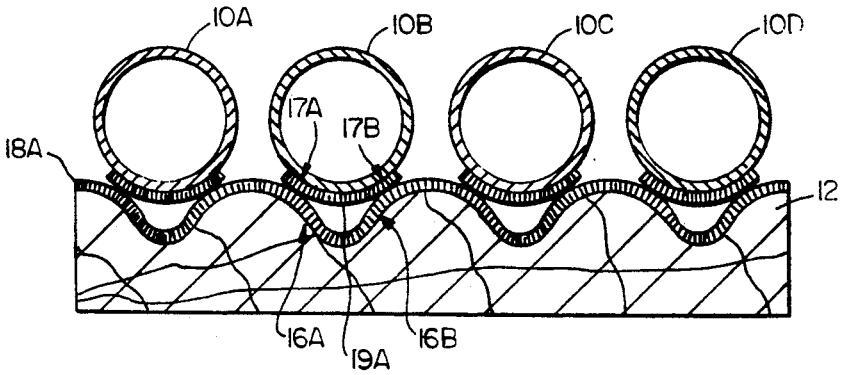
FIG. 2 is a section taken along the line 2—2 of FIG. 1.
Figure 3:
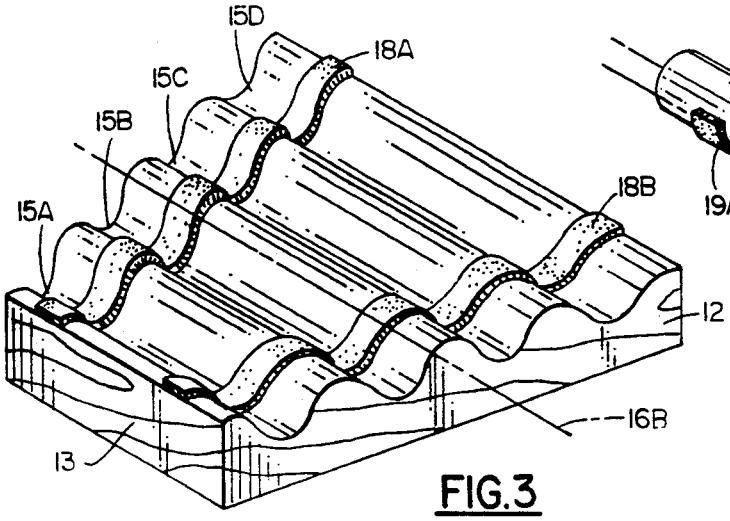
FIG. 3 is a perspective view of the base member with its first self-fastening fabric elements and with the percussion elements removed therefrom.

Each groove has side walls which present two parallel longitudinal first locus lines. The dot-dash lines 16A and 16B in FIG. 1 illustrate the parallel longitudinal first locus lines associated with the groove 15B. The locus line 16B of that pair is also visible in FIG. 3. In FIG. 2 arrows marked 16A and 16B point to where those locus lines are situated on the side walls of the groove 15B as seen on end.

The diameter of each of the percussion elements 10A to 10D is sufficiently great such that when the elements are juxtaposed over the respective grooves 15A to 15D as shown in FIG. 2 the first locus lines on the side walls of each of the grooves are juxtaposed with two corresponding parallel second locus lines on the surface of each associated percussion element. The arrows marked 17A and 17B point to where those locus lines are situated on the surface of the element 10B seen on end. The locus lines 17A and 17B are visible also in FIG. 4. The first and second locus lines are approximately the lines of tangential contact which would be made between the side walls of the groove and the cylindrical surface of the elements if no structure was interposed between them.

In accordance with the invention there is structure interposed between the side walls of the grooves 15A to 15D and the surface of the respective percussion elements 10A to 10D and that is first and second self-fastening fabric elements on the base member and the percussion elements respectively. As noted previously self-fastening fabric is that form of nylon material with both a surface of tiny hooks and a complementary surface of clinging pile which can be easily fastened and unfastened. Such material is sold under the trademark VELCRO. The first self-fastening elements may be a pair of strips 18A and 18B extending continuously from the narrow end 13 of the base member 12 to its wide end 14 on the upper surface thereof. The strips may be adhered in place by suitable glue or adhesive. It is preferred that the strips 18A and 18B be of the clinging pile form rather than that with the hooks. Since the first self-fastening elements 18A and 18B function only where they cross the first locus lines thereon it is not necessary that they be continuous as shown and lie across the bottom of each groove and across the crests between the grooves. The elements may instead be a plurality of patches secured to the respective groove side walls across their first locus lines. Also, aside from where the first self-fastening elements are located on the groove side walls, the grooves have no function and the base member 12 can assume any configuration between the strips 18A and 18B provided it does not contact the elements 10A to 10D.

Figure 4:
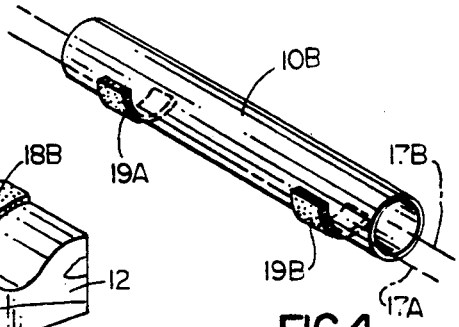
FIG. 4 is a perspective view of one typical percussion element with its second self-fastening fabric elements secured thereon.

The second self-fastening fabric elements are secured to the surface of each percussion element across the second locus lines thereon and are preferably a pair of patches, 19A and 19B for the element 10B as shown particularly in FIG. 4. The patches 19A and 19B may be adhered to the surface of the respective percussion elements by suitable glue or adhesive. The complementary surface of these second self-fastening fabric elements is that with the hooks rather than the clinging pile. The patches 19A and 19B are intended to span the second locus lines on the surface of the respective percussion elements substantially at their nodal points. Therefore in each successively longer percussion element the second self-fastening fabric patches 19A and 19B are spaced farther apart. To match this increased spacing from one percussion element to the next, the first self-fastening fabric strips 18A and 18B are closer together at the narrow end 13 of the base element 12 but diverge to be farthest apart at the wide end 14 thereof.

The assembly of the percussion elements to their support means is of the greatest simplicity. Each is simply laid in place over its groove and is positively held there by the self-fastening fabric. If not properly aligned with respect to the side edges of the base member 12, a given percussion element may simply be pulled off and reapplied at the desired location. The self-fastening fabric allows the percussion elements to be supported and fixed with minimal contact at the juxtaposed first and second locus lines 16A and B and 17A and B. No overlying securing member is needed contacting the elements from above. It is in the nature of the self-fastening fabric that it is highly absorptive of vibration and hence when the percussion elements are struck very little vibration is transmitted downwardly to the base member 12. The quality of emitted sound is therefore at an optimum.

The scope of the invention is to be determined by the following claims rather than the preferred embodiment described above.

I claim:

1. In a musical percussion instrument including a plurality of side-by-side elongated percussion elements, support means for said percussion elements comprising a) a base member having an upper surface formed with a plurality of side-by-side elongated grooves in which the respective percussion elements are longitudinally disposed, b) each groove having side walls configured such that two parallel longitudinal first locus lines thereon are juxtaposed with two parallel second locus lines on the surface of each associated percussion element, c) first self-fastening fabric elements secured to the groove side walls across the first locus lines thereon, and d) second self-fastening fabric elements secured to the surface of each percussion element across the second locus lines thereon, e) the first and second self-fastening fabric elements engaging one another and holding the percussion elements to the base member spaced from the upper surface thereof.

2. Support means for percussion elements according to claim 1 wherein the grooves extend fully across the upper surface of the base member.

3. Support means for percussion elements according to claim 1 wherein the side-by-side grooves are of substantially sinusoidal cross-section.

4. Support means for percussion elements according to claim 1 wherein the first self-fastening fabric elements are a pair of strips extending continuously from one of said grooves to the next on the upper surface of the base member.

5. Support means for percussion elements according to claim 1 wherein the second self-fastening fabric elements are pairs of patches spanning the second locus lines on the surface of the respective percussion elements.

6. Support means for percussion elements according to claim 5 wherein said percussion elements have two nodal points and the patches of each pair are secured substantially at the nodal points of the associated percussion element.

7. In a musical percussion instrument including a plurality of side-by-side elongated percussion elements of differing lengths having respective outer substantially cylindrical surfaces and two nodal points, support means for said percussion elements comprising a) a base member having an upper surface formed with a plurality of side-by-side elongated grooves of substantially sinusoidal cross-section in which the respective percussion elements are longitudinally disposed, b) each groove having side walls configured such that two parallel longitudinal first locus lines thereon are juxtaposed with two parallel second locus lines on the cylindrical surface of each associated percussion element, c) self-fastening fabric elements secured to the groove side walls across the first locus lines thereon, d) a pair of self-fastening fabric patches secured to the cylindrical surface of each percussion element substantially at the nodal points thereof across the second locus lines, e) the percussion elements being arranged on the base member in the order of their respective lengths, and f) the self-fastening fabric elements in each successive groove being spaced successively farther apart from the shortest to the longest percussion elements to engage the successive pairs of self-fastening fabric patches and hold the percussion elements to the base member spaced from the upper surface thereof.

8. Support means for percussion elements according to claim 7 wherein the grooves extend fully across the upper surface of the base member.

9. Support means for percussion elements according to claim 7 wherein the self-fastening fabric elements are a pair of strips extending continuously from one of said grooves to the next on the upper surface of the base member and diverging apart from the shortest to the longest of the percussion elements.

* * * * *